United States Patent [19]

Courtney

[11] Patent Number: 4,770,249

[45] Date of Patent: Sep. 13, 1988

[54] METHOD AND APPPARATUS FOR REDUCTION OF WELL ASSEMBLY TIME

[75] Inventor: Gregory L. Courtney, Mandeville, La.

[73] Assignee: Shell Offshore Inc., Houston, Tex.

[21] Appl. No.: 30,396

[22] Filed: Mar. 26, 1987

[51] Int. Cl.[4] ..... E21B 17/00; E21B 19/00

[52] U.S. Cl. ..... 166/379; 166/89; 166/380; 166/382

[58] Field of Search ..... 166/88, 89, 75.1, 380, 166/382, 379

[56] References Cited

U.S. PATENT DOCUMENTS

| | | | |
|---|---|---|---|
| 1,849,374 | 3/1932 | McEvoy, Jr. et al. | 166/89 |
| 2,034,698 | 3/1936 | Hild | 166/89 X |
| 2,118,094 | 5/1938 | McDonough et al. | 166/89 X |
| 3,190,354 | 6/1965 | Stone | 166/379 X |
| 3,336,978 | 8/1967 | Hynes | 166/382 X |
| 3,391,735 | 7/1968 | Schramm et al. | 166/382 X |
| 3,744,562 | 7/1973 | Priebe et al. | 166/89 X |

*Primary Examiner*—Stephen J. Novosad
*Attorney, Agent, or Firm*—Paul I. Douglas

[57] ABSTRACT

A method and apparatus are disclosed for use in reduction of well assembly time. A dual hanger casing head is supported by a previously driven drive pipe at the desired surface location of the well. A diverter assembly is connected to the upper end of the dual hanger casing head. Both a large diameter casing assembly and a small diameter casing assembly are installed downwardly through the diverter assembly and supported within the dual hanger casing head, prior to disconnection and removal of the diverter assembly from the top of the dual hanger casing head. Removal of the diverter assembly only after the installation of both casing assemblies significantly reduces the well assembly time, and reduces the risk to the equipment and personnel associated with the well assembly process.

6 Claims, 3 Drawing Sheets

METHOD AND APPPARATUS FOR REDUCTION OF WELL ASSEMBLY TIME

BACKGROUND OF THE INVENTION

During the drilling of wells the above-ground well equipment is assembled in a certain sequence to provide support and a safe pressure seal for strings of casing and/or tubing that are lowered downwardly into the earth. In a typical well installation, a drive pipe is initially installed at the desired well location, followed by a conductor, large diameter (surface) casing, protective casing, and production casing. The weight of the large diameter casing is typically supported by use of a large diameter casing hanger, (FIG. 1), supported within a bowl that makes up a lower portion of the well assembly.

Once the large diameter casing is set, a diverter assembly used for well flow control is removed from the bowl. Another bowl is installed on top of the large diameter casing bowl. The diverter assembly is then reinstalled on top of the new bowl and then the drilling process is repeated to allow a small diameter (protective) casing to be lowered downwardly within the hole.

During the period when the diverter assembly is removed from the large diameter casing hanger bowl, the personnel and equipment associated with the well assembly process are exposed to a greater risk of an uncontrolled well blowout than when the diverter assembly is installed on the large diameter casing hanger bowl.

From an economic standpoint, disconnection of the diverter assembly from the large diameter casing hanger bowl and its subsequent reconnection requires time and effort that could be better directed to the installation of the casing and tubing within the well.

A method and apparatus therefore need be developed that eliminates the unnecessary disassembly of the diverter assembly, with its subsequent reinstallation upon the well as it is being assembled. Such a method and apparatus would decrease the assembly costs of each well, as well as increase the safety of the personnel and equipment associated with the well installation.

SUMMARY OF THE INVENTION

In a preferred embodiment of the present invention, a large diameter casing assembly and a small diameter casing assembly are supported within a dual hanger casing head which has been connected to the well's drive pipe. Both casing assemblies have been lowered downward through the well's diverter assembly without removal of the diverter assembly.

The diverter assembly does not have to be removed prior to installation of the small diameter casing assembly. Since both casing assemblies are supported by the dual hanger casing head, the dual hanger casing head replaces what used to be two separate bowls, each bowl having an independent casing assembly suspended therefrom.

Well assembly time is subsequently decreased since the diverter assembly need not be disassembled between the installation of the casing assemblies.

More specifically the apparatus of the claimed invention can be seen to comprise a dual hanger casing head having an opening defined therethrough, with an upper shoulder defined about the inner periphery of the dual hanger casing head in an upwardly directed manner.

The apparatus can also be seen to include a large diameter casing hanger having an opening defined therethrough, with an upwardly directed upper shoulder defined about the periphery thereof, and with a downwardly directed lower shoulder defined about the outer periphery thereof, the lower shoulder being supported by the upper shoulder of the dual hanger casing head.

The apparatus of the present invention also includes a small diameter casing hanger having an opening defined therethrough, with a downwardly directed lower shoulder defined about the outer periphery thereof, wherein the lower shoulder is supported by the upper shoulder of the large diameter casing hanger.

It is therefore an object of the present invention to reduce the assembly time of a well.

It is also an object of the present invention to minimize or reduce the hazards to the personnel and equipment associated with a well assembly process, by use of the method and apparatus of the subject invention.

These and other features, objects, and advantages of the present invention will become apparent from the following detailed description, wherein reference is made to the Figures in the accompanying drawings.

IN THE DRAWINGS

DETAILED DESCRIPTION

Figure 1:
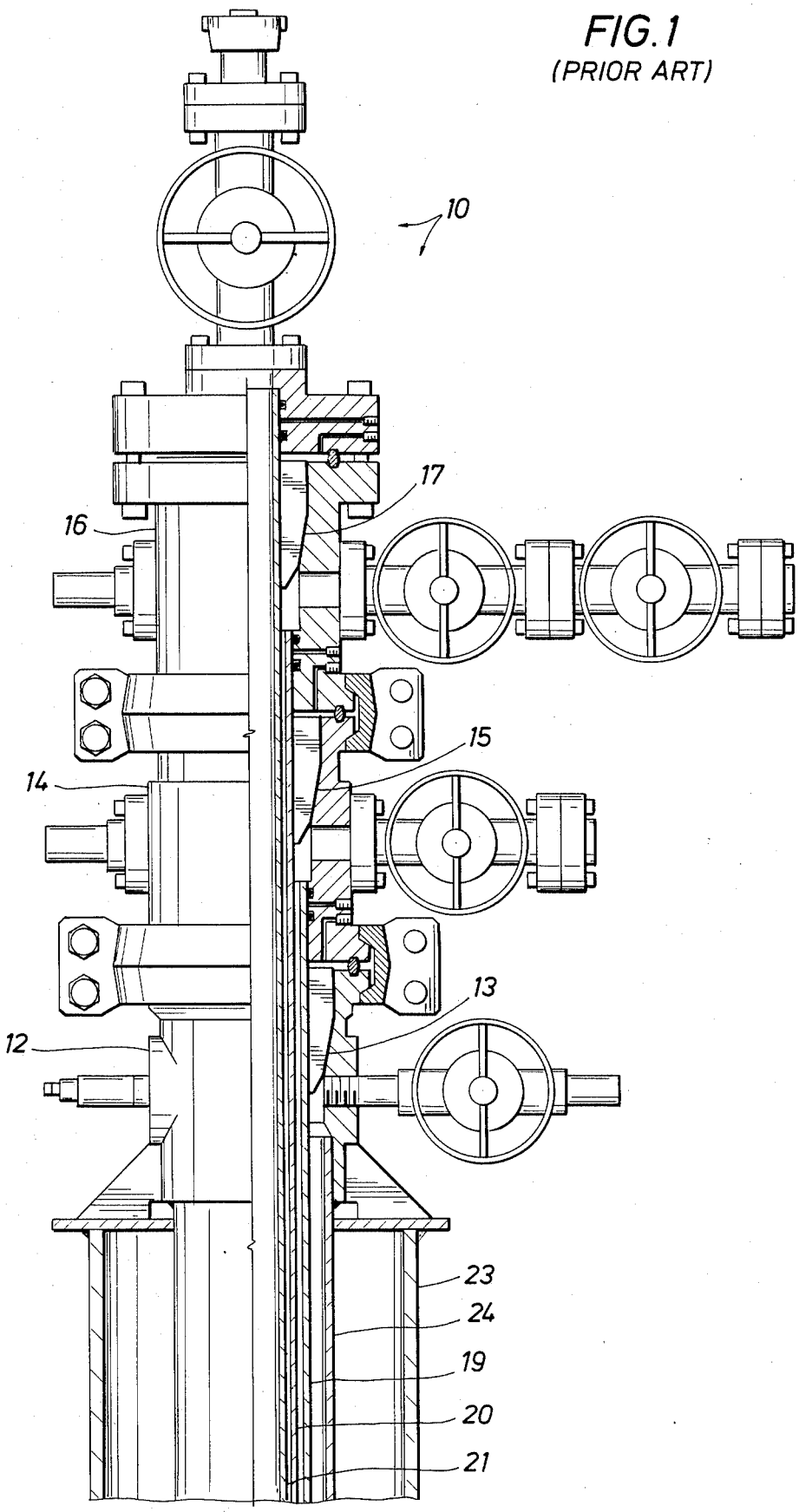
FIG. 1 (PRIOR ART)
FIG. 1 is a schematic diagram of a prior art well assembly.

Referring now to FIG. 1, a well 10 assembled according to the teachings of the prior art can be seen to have a large diameter casing hanger bowl 12 which supports a large diameter casing hanger 13, a small diameter (protective) casing hanger bowl 14 which supports a protective casing hanger 15, and a production casing hanger bowl 16 which supports a production casing hanger 17. Hangers 13, 15, 17 transfer the weight of casing 19, casing 20, and casing 21 to bowls 12, 14, and 16, respectively. The drive pipe 23 and conductor 24 stabilize and support the above-referenced well equipment, as is well known to the art.

As can be seen each casing hanger is supported by a separate bowl. Prior to installation of one bowl upon another well safety equipment must be removed from the lower bowl. This removal and subsequent reinstallation of the same well safety equipment increases the overall assembly time of a well.

Figure 2:
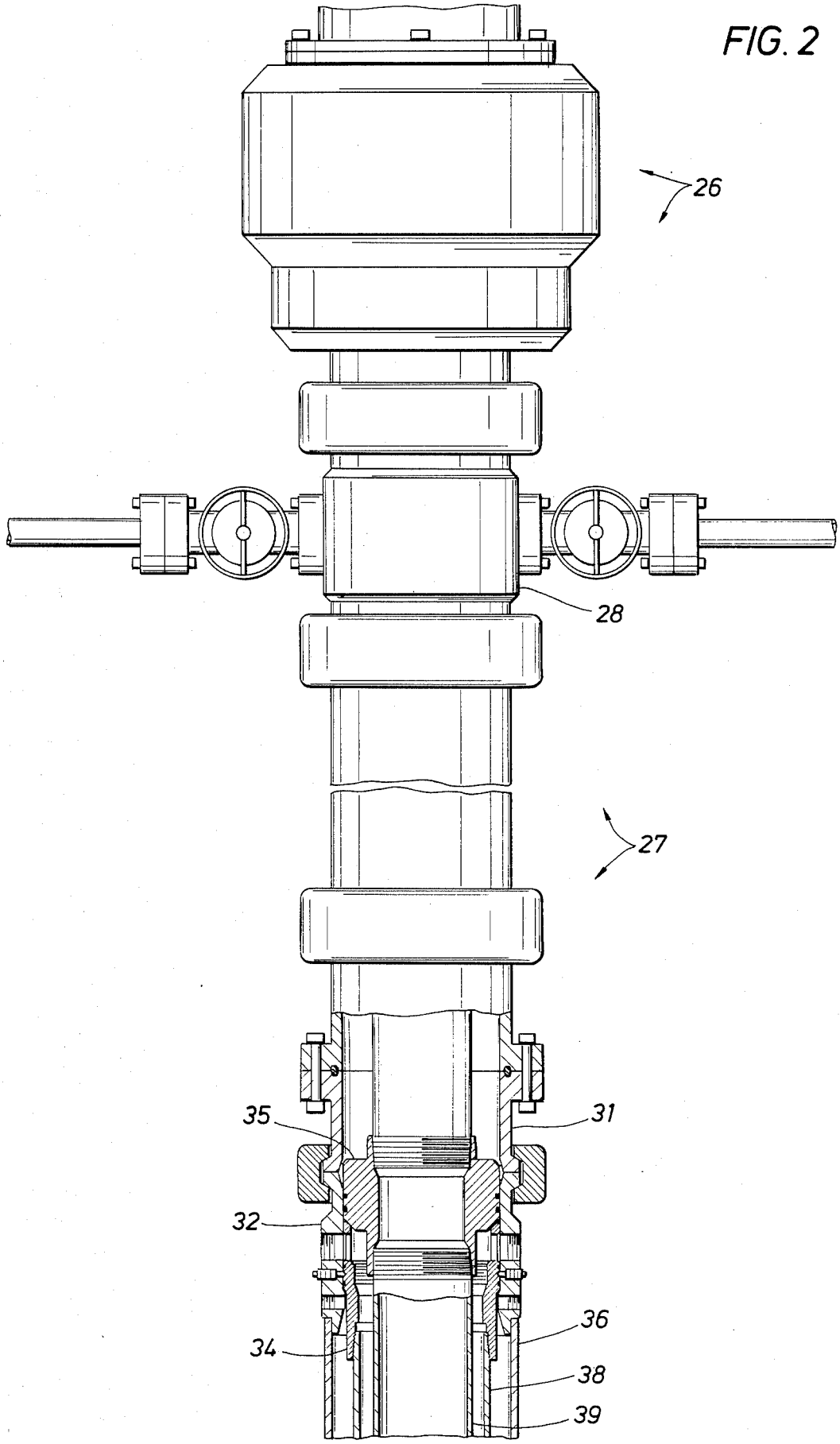
FIG. 2 is a schematic diagram showing a dual hanger casing head having a large diameter casing hanger and a small diameter casing hanger located therein.
Figure 3:
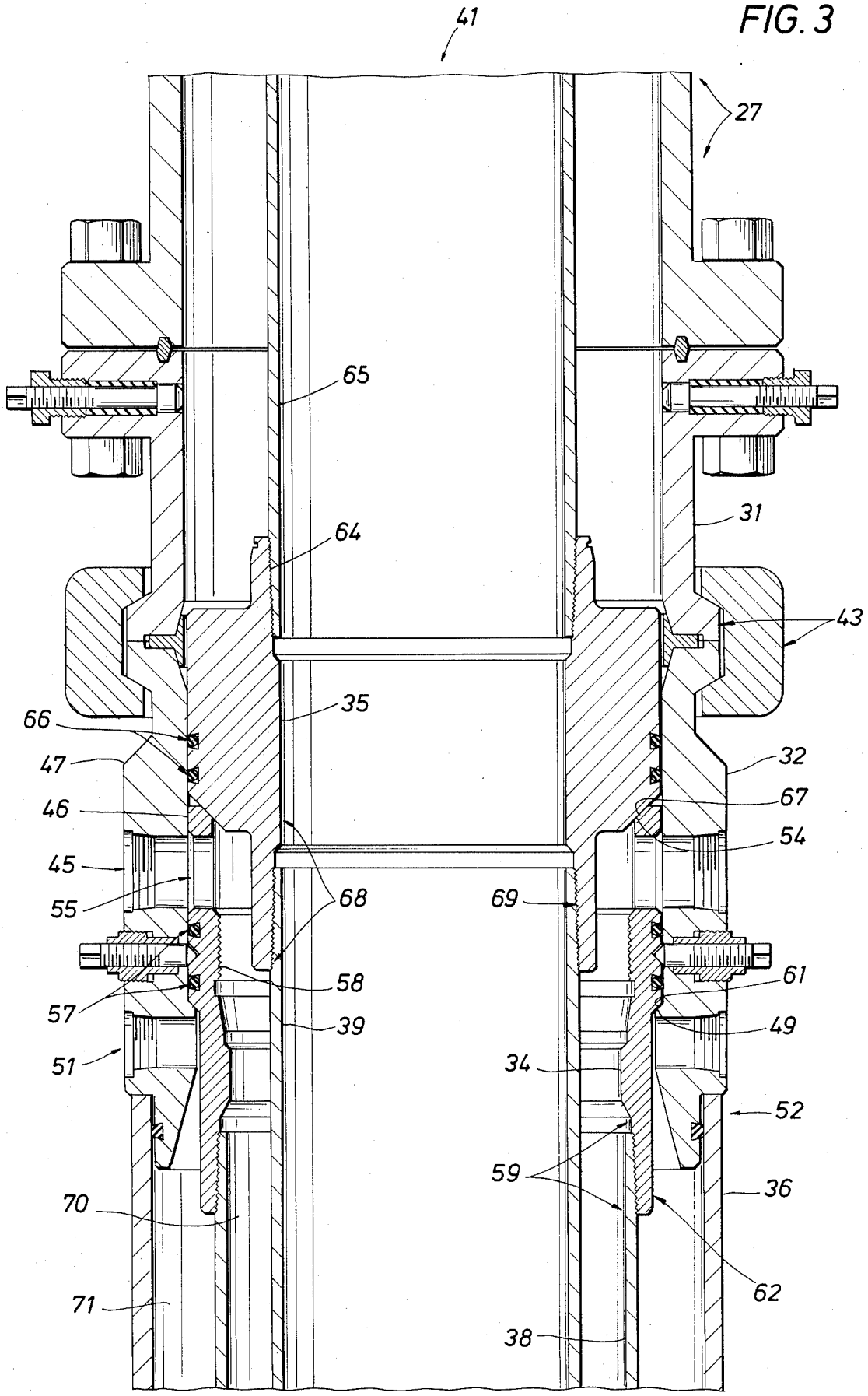
FIG. 3 is a schematic diagram which shows the apparatus of the claimed invention in more detail.

Referring now to FIGS. 2 and 3 well 26 is shown being assembled, having a diverter assembly 27, comprising a diverter spool 28 located beneath the annular blowout preventer 29, the diverter assembly 27 consisting of elements of well safety control equipment well known to the art.

The diverter assembly 27 can be connected to the wellhead currently being assembled by use of drilling adapter 31 which is operatively connected to the top of the dual hanger casing head 32. The dual hanger casing head 32 can be seen to have a large diameter casing hanger 34 and a small diameter casing hanger 35 located therein. The casing head 32 is shown supported by drive pipe 36; the large diameter casing hanger 34 supports the weight of the large diameter casing string 38, the small diameter casing hanger 35 supports the weight of the small diameter casing string 39, as is well known to the art.

Referring now more specifically to FIG. 3, the dual hanger casing head 32 can be seen to have a central opening 41 defined therethrough nominally having a circular cross-section. Diverter assembly connection means 43, comprising in a preferred embodiment a Graylock seal ring and Graylock lock clamp stock Nos. 50218 and 163198 respectively, manufactured by Gray Tool Company of Houston, Tex., are located at the upper end of the dual hanger casing head 32 in order to operatively connect the diverter assembly 27 to the dual hanger casing head.

A first fluid passage means 45 such as an opening well known to the art is shown defined between the inner surface 46 and the outer surface 47 of the casing head 32, the first fluid passage means 45 being located below the diverter assembly connection means 43. The casing head 32 can also be seen to include an upper shoulder 49 located below the first fluid passage means, the upper shoulder 49 being defined about the periphery of the inner surface of the casing head in a upwardly directed manner.

A second fluid passage means 51 such as an opening well known to the art is located below the upper shoulder 49, the fluid passage means 51 being defined between the inner surface 46 and the outer surface 47 of the dual hanger casing head. The casing head can also be seen to include drive pipe connection means 52 located at the lower end of the casing head for the purpose of connecting the casing head to previously driven drive pipe 36, the connection means 52 in a preferred embodiment comprising a seal between the head and the drive pipe, and a shoulder formed above the drive pipe 36 with a suitable cooperating surface to allow welding of the drive pipe 36 to the casing head 32.

The large diameter casing hanger 34 can be seen to have a central opening defined therethrough in common with the dual hanger casing head opening 41. An upwardly directed upper shoulder 54 is defined at the upper end thereof. A third fluid passage means 55 such as an opening well known to the art is defined between the inner surface and the outer surface of the casing hanger 34. The third fluid passage means 55 is located adjacent and placed in fluid communication with the first fluid passage means 45 of the dual hanger casing head 32.

Large diameter casing hanger 34 also includes first seal means 57 carried by the casing hanger 34, the seal means such as a pair of O-rings well known to the art having a sealing surface defined between the casing hanger 34 and the dual hanger casing head 32, the first seal means 57 being located between the first fluid passage means 45 and the second fluid passage means 51 of the dual hanger casing head 32.

First landing joint connection means 58 such as threads well known to the art are formed about the inner surface of the casing hanger 34 and allow a landing joint (not shown) to be threadably engaged with connection means 58 in order to lower the large diameter casing assembly 59 downwardly within the well.

Large diameter casing hanger 34 also includes a downwardly directed lower shoulder 61 located in a preferred embodiment below the first seal means 57 and above the second fluid passage means 51 of the dual hanger casing head 32, the lower shoulder 61 being supported by the upper shoulder of the dual hanger casing head 32. Casing hanger 34 also includes a large diameter casing string connection means 62 such as cooperating threads well known to the art in order to allow the casing hanger 34 to be threadedly engaged with the large diameter casing string 38 of the large diameter casing assembly 59.

The apparatus of the present invention can also be seen to include a small diameter casing hanger 35 having a central opening defined therethrough formed in common with the dual hanger casing head opening 41 and the large diameter casing hanger opening. Small diameter casing hanger 35 includes second landing joint connection means 64 such as cooperating threads formed about the inner surface of the casing hanger 35 between landing joint 65 and casing hanger 35 as is well known to the art.

Casing hanger 35 also includes second seal means 66 such as a pair of O-rings well known to the art carried by the small diameter casing hanger, seal means 66 having a sealing surface defined between the small diameter casing hanger 35 and the dual hanger casing head 32, the seal means 66 being located above the first fluid passage means 45 of the dual hanger casing head 32.

Small diameter casing hanger 35 also includes a downwardly directed lower shoulder 67 defined about the outer surface of the casing hanger 35 below the second seal means 66, the lower shoulder 67 supported by the upper shoulder 54 of the large diameter casing hanger 34. Small diameter casing string connection means 69 such as threads well known to the art are located at the lower end of the casing hanger 35. Connection means 69 operatively connect the casing hanger 35 to the upper end of the small diameter casing string 39 which has been previously lowered downwardly through the central opening of the large diameter casing hanger 34. The small diameter casing hanger 35 and the small diameter casing string 39 when connected by connection means 69 comprise the small diameter casing assembly 68.

It can be seen that the first fluid passage means 45 and the third fluid passage means 55 are placed in fluid communication with a first annular passage 70 defined in annular manner between the small diameter casing string and the large diameter casing string. The second fluid passage means 51 are placed in fluid communication with a second annular passage 71 defined in an annular manner between the large diameter casing string and the drive pipe.

At a well location where a drive pipe has previously been driven the preferred method of the present invention would comprise the following steps. The dual hanger casing head would be operatively connected by welding to the upper end of the drive pipe. The diverter assembly would be operatively connected to the upper end of the dual hanger casing head, by use of the drilling adapter 31. The well would then be drilled to a sufficient depth to allow installation of the large diameter casing assembly 59. The large diameter casing assembly 59 would then be assembled, the lower portion of the assembly being lowered downward through an opening drilled through the diverter assembly and the dual hanger casing head into the earth as is well known to the art.

The large diameter casing assembly 59 would then be supported from the dual hanger casing head 32.

After the large diameter casing assembly 59 has been lowered and set in place, and the landing joint (not shown) has been removed, the large diameter casing string may be cemented through the use of a drill pipe that has been lowered downwardly through the diverter assembly and the casing string. In a "prior art" well, in the abnormal situation where the large diameter casing string could not be "hung off" and the landing joint removed, then one could not cement through the drill pipe because the diverter assembly 27 would not be installed above the large diameter casing hanger and therefore it could not be utilized in a well control situation or problem. Therefore, this is a point in favor of this type of system.

The well would then be drilled to a sufficient depth to allow installation of the small diameter casing assembly 68. A small diameter casing assembly 68 would then be assembled, the lower portion of the assembly 68 being lowered downward through an opening drilled through the diverter assembly and the large diameter casing assembly into the earth as is well known to the art.

The small diameter casing assembly would then be supported from the large diameter casing hanger. After installation of both the small diameter casing assembly and large diameter casing assembly within the dual hanger casing head the diverter assembly would then be disconnected from the upper end of the dual hanger casing head.

From study of FIG. 3 it can be seen that the steps of operatively connecting the diverter assembly to the upper end of the dual hanger casing head may be accomplished by operatively connecting the drilling adapter to the lower end of the diverter assembly, lowering the lower end of the drilling adapter into contact with the upper end of the dual hanger casing head, and thereafter connecting the lower end of the drilling adapter to the upper end of the dual hanger casing head.

The large diameter casing assembly may be supported from the dual hanger casing head after the large diameter casing assembly has been moved downwardly through the opening defined through the dual hanger casing head, by operatively contacting the downwardly directed lower shoulder formed about the large diameter casing hanger with the cooperating upwardly directed upward shoulder formed about the dual hanger casing head.

In a similar manner the small diameter casing assembly may be supported from the large diameter casing hanger, after the small diameter casing assembly has been moved downwardly through the opening defined through the large diameter casing hanger, by operatively contacting the downwardly directed lower shoulder formed about the small diameter casing hanger with the cooperating upwardly directed upper shoulder formed about the large diameter casing hanger.

In a preferred embodiment of the present invention the dual hanger casing head may be ordered, as with the other equipment referenced hereinbelow, from Gray Tool Company of Houston, Tex., the casing head 32 having a stock No. 163174, the large diameter casing hanger having a stock No. 165012, and the small diameter casing hanger having a stock No. 163182.

Many other variations and modifications may be made in the apparatus and techniques hereinbefore described, both by those having experience in this technology, without departing from the concept of the present invention. Accordingly, it should be clearly understood that the apparatus and methods depicted in the accompanying drawings referred to in the foregoing description are illustrative only and are not intended as limitations on the scope of the invention.

I claim as my invention:

1. A method of reducing the assembly time of a well, said method comprising the steps of;

operatively connecting a dual hanger casing head to the upper end of a drive pipe previously driven downwardly into the earth at the location of said well,, operatively connecting a diverter assembly to the upper end of said dual hanger casing head, assembling a large diameter casing assembly, having a large diameter casing string and a large diameter casing hanger operatively connected to the upper end of said large diameter casing string, supporting said large diameter casing assembly from said dual hanger casing head, assembling a small diameter casing assembly, having a small diameter casing string and a small diameter casing hanger operatively connected to the upper end of said small diameter casing string, supporting said small diameter casing assembly from said large diameter casing hanger, and operatively disconnecting said diverter assembly from the upper end of said dual hanger casing head.

2. The method of claim 1 wherein the step of operatively connecting said diverter assembly to the upper end of said dual hanger casing head includes the further steps of;

operatively connecting a drilling adapter to the lower end of the diverter assembly, lowering the lower end of the drilling adapter into contact with the upper end of the dual hanger casing head, and connecting the lower end of the drilling adapter to the upper end of the dual hanger casing head.

3. The method of claim 1 wherein the step of supporting said large diameter casing assembly from said dual hanger casing head further includes the steps of;

moving said large diameter casing assembly downwardly through an opening defined centrally through said dual hanger casing head, and operatively contacting a downwardly-directed lower shoulder formed about said large diameter casing hanger with a cooperating upwardly-directed upper shoulder formed about said dual hanger casing head.

4. The method of claim 1 wherein the step of supporting said small diameter casing assembly from said large diameter casing hanger further includes the steps of;

moving said small diameter casing assembly downwardly through an opening defined centrally through said large diameter casing hanger, and operatively contacting a downwardly-directed lower shoulder formed about said small diameter casing hanger with a cooperating upwardly-directed upper shoulder formed about said large diameter casing hanger.

5. An apparatus for use in reducing the assembly time of a well, said apparatus comprising;

a dual hanger casing head having, a central opening defined therethrough, diverter assembly connection means located at the upper end thereof operatively connected to a diverter assembly located above said dual hanger casing head, a first fluid passage means defined between the inner surface and the outer surface of said dual hanger casing head below said diverter assembly connection means, an upper shoulder located below said first fluid passage means defined about the periphery of said inner surface of said dual hanger casing head in an upwardly-directed manner, a second fluid passage means located below said upper shoulder defined between the inner surface and the outer surface of said dual hanger casing head, and drive pipe connection means located at the lower end thereof connected to previously driven drive pipe, a large diameter casing hanger having, a central opening defined therethrough common with said dual hanger casing head opening, an upwardly-directed upper shoulder defined at the upper end thereof, a third fluid passage means defined between the inner surface and said outer surface of said large diameter casing hanger, said third fluid passage means located adjacent and in fluid communication with said first fluid passage means of said dual hanger casing head, first seal means carried by said large diameter casing hanger having a sealing surface defined between said large diameter casing hanger and said dual hanger casing head, said first seal means located between said first fluid passage means and said second fluid passage means of said dual hanger casing head, first landing joint connection means formed about the inner surface of said large diameter casing hanger, located below said first fluid passage means, a downwardly-directed lower shoulder located below said first seal means and above said second fluid passage means of said dual hanger casing head, said lower shoulder supported by said upper shoulder of said dual hanger casing head, and large diameter casing string connection means located at the lower end thereof connected to the upper end of a large diameter casing string previously lowered downwardly through said central opening of said dual hanger casing head, and a small diameter casing hanger having, a central opening defined therethrough common with said dual hanger casing head opening and said large diameter casing hanger opening, second landing joint connection means formed about the inner surface of said small diameter casing hanger, second seal means carried by said small diameter casing hanger having a sealing surface defined between said small diameter casing hanger and said dual hanger casing head, said second seal means located above said first fluid passage means of said dual hanger casing head, a downwardly-directed lower shoulder defined about the outer surface thereof below said second seal means, said lower shoulder supported by said upper shoulder of said large diameter casing hanger, and small diameter casing string connection means located at the lower end thereof connected to the upper end of a small diameter casing string previously lowered downwardly through said central opening of said large diameter casing hanger, and wherein said first fluid passage means and said third fluid passage means are placed in fluid communication with a first annular passage defined in an annular manner between said small diameter casing string and said large diameter casing string, and wherein said second fluid passage means is placed in fluid communication with a second annular passage defined in an annular manner between said large diameter casing string and said drive pipe.

6. Apparatus for use in reducing the assembly time of a well, said apparatus comprising;

a dual hanger casing head having, an opening defined therethrough, diverter assembly connection means located at the upper end thereof operatively connected to a diverter assembly located above said dual hanger casing head, a first fluid passage means defined between the inner surface and the outer surface of said dual hanger casing head below said diverter assembly connection means, an upper shoulder defined about the periphery of said inner surface of said dual hanger casing head in an upwardly-directed manner, a second fluid passage means located below said first fluid passage means defined between the inner surface and the outer surface of said dual hanger casing head, and drive pipe connection means located at the lower end thereof connected to previously driven drive pipe, a large diameter casing hanger having, an opening defined therethrough common with said dual hanger casing head opening, an upwardly-directed upper shoulder defined adjacent the upper end thereof, a third fluid passage means defined between the inner surface and said outer surface of said large diameter casing hanger, said third fluid passage means located adjacent and placed in fluid communication with said first fluid passage means of said dual hanger casing head, first seal means having a sealing surface defined between said large diameter casing hanger and said dual hanger casing head, said first seal means located between said first fluid passage means and said second fluid passage means of said dual hanger casing head, first landing joint connection means formed about the inner surface of said large diameter casing hanger, a downwardly-directed lower shoulder formed about the outer surface thereof, said lower shoulder supported by said upper shoulder of said dual hanger casing head, and large diameter casing string connection means connected to the upper end of a large diameter casing string previously lowered downwardly through said opening of said dual hanger casing head, and a small diameter casing hanger having, an opening defined therethrough common with said dual hanger casing head opening and said large diameter casing hanger opening, second landing joint connection means formed about the inner surface of said small diameter casing hanger, second seal means carried by said small diameter casing hanger having a sealing surface defined between said small diameter casing hanger and said dual hanger casing head, said second seal means located above said first fluid passage means of said dual hanger casing head, a downwardly-directed lower shoulder defined about the outer surface thereof, said lower shoulder supported by said upper shoulder of said large diameter casing hanger, and small diameter casing string connection means connected to the upper end of a small diameter casing string previously lowered downwardly through said opening of said large diameter casing hanger, and wherein said first fluid passage means and said third fluid passage means are placed in fluid communication with a first annular passage defined in an annular manner between said small diameter casing string and said large diameter casing string, and wherein said second fluid passage means is placed in fluid communication with a second annular passage defined in an annular manner between said large diameter casing string and said drive pipe.

* * * * *